US012680402B2

(12) United States Patent
Bhudolia et al.

(10) Patent No.: US 12,680,402 B2
(45) Date of Patent: Jul. 14, 2026

(54) COMPOSITE HOLLOW PROFILES FOR DOWNHOLE

(71) Applicant: Halliburton Energy Services, Inc., Houston, TX (US)

(72) Inventors: Somen Kumar Bhudolia, Singapore (SG); Michael Linley Fripp, Singapore (SG); Sandeep Thatathil, Singapore (SG); Arpana Singh, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 66 days.

(21) Appl. No.: 18/478,720

(22) Filed: Sep. 29, 2023

(65) Prior Publication Data

US 2025/0109643 A1 Apr. 3, 2025

(51) Int. Cl.
*E21B 23/00* (2006.01)
*E21B 41/00* (2006.01)

(52) U.S. Cl.
CPC ..... *E21B 23/00* (2013.01); *E21B 41/00* (2013.01)

(58) Field of Classification Search
CPC ..... E21B 41/00; C08G 63/11; C09D 167/00
See application file for complete search history.

(56) References Cited

U.S. PATENT DOCUMENTS 3,002,534 A * 10/1961 Noland ..... F16L 9/12 138/144
5,213,379 A * 5/1993 Taniguchi ..... B29C 70/14 138/140
6,300,762 B1 * 10/2001 Thomas, Jr. ..... E21B 47/017 324/338
6,467,557 B1 * 10/2002 Krueger ..... E21B 4/18 175/45
8,123,888 B2 2/2012 Hammami et al.
8,678,042 B2 3/2014 Quigley et al.
8,763,647 B2 7/2014 Quigley et al.
8,800,605 B2 8/2014 Barlow et al.
9,174,393 B2 11/2015 Bartel et al.
9,322,495 B2 4/2016 Duncan et al.
9,488,027 B2 11/2016 Guest et al.
9,677,372 B2 * 6/2017 Smith ..... E21B 33/1208
10,000,989 B2 6/2018 Sherlin
11,130,293 B2 9/2021 Meyer et al.
11,254,032 B2 2/2022 Lan et al.
2008/0283236 A1 * 11/2008 Akers ..... E21B 43/121 277/336
2012/0245014 A1 9/2012 Jones et al.
(Continued)

OTHER PUBLICATIONS

Assembly and Reuse of Aromatic Thermosetting Copolyester. speautomotive.com/wp-content/uploads/2021/11/Assembly-and-Reuse-of-Aromatic-ThermoSetting-coPolyester.pdf (Year: 2021).*
(Continued)

*Primary Examiner* — Tara Schimpf
*Assistant Examiner* — Daniel T Craig
(74) *Attorney, Agent, or Firm* — Scott Richardson; C. Tumey Law Group PLLC

(57) ABSTRACT

Methods and apparatuses including a hollow profile for downhole in a borehole, the hollow profile including a composite of an aromatic copolyester thermoset (ACT) and a reinforcement material, wherein the reinforcement material includes fibers or particles, or both.

15 Claims, 5 Drawing Sheets

(56) References Cited

U.S. PATENT DOCUMENTS

| | | | | |
|---|---|---|---|---|
| 2013/0025859 | A1* | 1/2013 | Liang | E21B 41/00 507/224 |
| 2015/0219254 | A1* | 8/2015 | Lee | B29C 65/5057 285/294.1 |
| 2015/0284586 | A1 | 10/2015 | Economy et al. | |
| 2018/0086894 | A1 | 3/2018 | Roy et al. | |
| 2020/0023598 | A1 | 1/2020 | Lan et al. | |

OTHER PUBLICATIONS

Meyer, Jacob (Assembly and Reuse of Aromatic Thermosetting Copolyester. speautomotive.com/wp-content/uploads/2021/11/Assembly-and-Reuse-of-Aromatic-ThermoSetting-coPolyester.pdf) (Year: 2021).*

Lan, Pixiang (Jun. 1, 2020; NoweTM Coatings for Extreme Bearing Applications,ATSP Innovations. https://www.atspinnovations.com/blog/nowe-coatings-for-extreme-bearing-applications) (Year: 2020).*

Lan, Pixiang, et al. "High temperature and high pressure tribological experiments of advanced polymeric coatings in the presence of drilling mud for oil & gas applications." Tribology International Journal, vol. 120, Apr. 2018, pp. 218-225. PDF file. 8 pages.

International Search Report and Written Opinion for International Patent Application No. PCT/US2023/077334 dated Jun. 18, 2024. PDF file. 8 pages.

Bakir, Mete; Henderson, Christine N.; Meyer, Jacob L.; Oh, Junho; Miljkovic, Nenad; Kumosa, Maciej; Economy, James; Jasiuk, Iwona (2018). Effects of environmental aging on physical properties of aromatic thermosetting copolyester matrix neat and nanocomposite foams. Polymer Degradation and Stability, 147(), 49-56.

Yi Di Boon;Sunil Chandrakant Joshi;Somen Kumar Bhudolia; (2021). Review: Filament Winding and Automated Fiber Placement with In Situ Consolidation for Fiber Reinforced Thermoplastic Polymer Composites.

Bashandeh, et al., Research Article, Tribology of self-lubricating high performance ATSP, PI, and PEEK-based polymer composites up to 300° C., Oct. 2021.

ATSP Innovations, Estherm™, Advanced thermosetting polyesters, 2018.

Shau, Abhra & Jana, Chhayarani & De, P & Ray, P. (2012). Aspects of polymers and polymeric composites in chemical processindustries.

* cited by examiner

COMPOSITE HOLLOW PROFILES FOR DOWNHOLE

BACKGROUND

Boreholes may be drilled into subterranean formations to recover valuable hydrocarbons, among other functions. Operations may be performed before, during, and after the borehole has been drilled to produce and continue the flow of the hydrocarbon fluids to the surface. Tubulars and downhole tools in the borehole or wellbore may facilitate the production of the hydrocarbon fluids from the subterranean formation.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
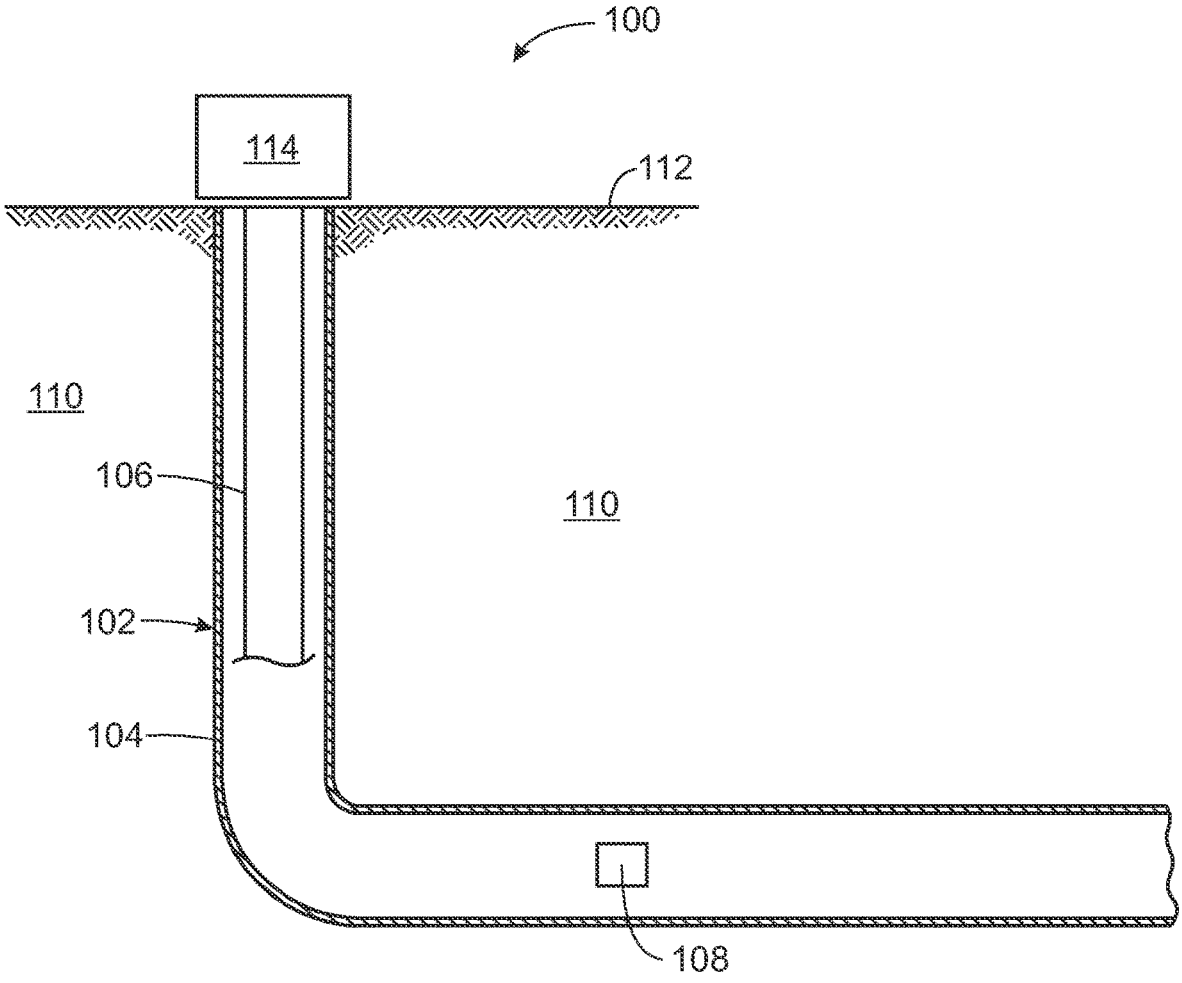
FIG. 1 is a diagram of a well site that includes a composite hollow profile in a wellbore.

Aspects of the present disclosure include a composite hollow profile including an aromatic copolyester thermoset (ACT) reinforced with filler material and in which the composite hollow profile is for use in a borehole. Embodiments herein include an apparatus for use in a borehole, and in which the apparatus includes a hollow profile (for use in a borehole) that is a composite such as an ACT reinforced with filler material. While the ACT is a thermoset, the ACT exhibits thermoplastic behavior. Embodiments of the ACT may be a vitrimer.

Disclosed herein are downhole equipment including a conduit or hollow profile formed from a composite of an ACT and reinforcement material (e.g., fibers). The ACT may be, for example, an aromatic thermosetting copolyester (ATSP) available from ATSP Innovations, LLC having headquarters in Houston, Texas, USA. The ACT can be labeled as a resin or as a polymer. The ACT is formed by crosslinking oligomers that have lower molecular weight than the ACT. Both the oligomers (before crosslinking) and the ACT (as a thermoset after crosslinking) can have the following structure in a repeat unit of the main chain of the chemical structure:

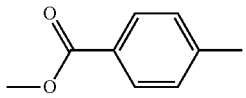

which includes the aromatic ring (benzene ring). Also, the depicted structure includes a carbon single bonded to an oxygen, double bonded to another oxygen, and single bonded to a carbon of the aromatic ring.

Thus, the ACT (e.g., ATSP) includes an aromatic polyester backbone. The oligomers and the ACT may be carboxylic acid-capped (capped with a carboxylic acid functional group as end group) or acetoxy-capped (capped with an acetoxy functional group as an end group). The crosslinked network of the ACT morphology may be composed of an aromatic polyester backbone interconnected via covalent single and double oxygen bonds. At least a portion of the ACT matrix is generally amorphous. The percent crystallinity may be, for example, in the range of 0% (no crystallinity) to 6%.

An embodiment may include an apparatus having a structure that is a hollow profile for downhole in a borehole, and in which the hollow profile includes a composite of ACT (e.g., ATSP resin) and a reinforcement material (e.g., particles or fibers, or both). In implementations, the reinforcement material as fibers can include carbon, glass, aramid (can be aromatic polyamide), boron, basalt, polyethylene, polypropylene, poly(p-phenylene-2,6-benzobisoxazole) (PBO) (Zylon®), natural fibers like flax, jute, and others. If natural fibers are utilized, the natural fibers can include flax or jute, or both, and other natural fibers. The apparatus can be a tubular or a downhole tool. In examples, the downhole tool can support a radial force either from a differential pressure or from a spring force. In implementations, the downhole tool can include the hollow profile as tubing, piping, a pressure housing, a valve body, or a tool mandrel, or any combinations thereof. For instance, the downhole tool may have a mandrel (tool mandrel) including the hollow profile, and thus wherein the hollow profile may be a mandrel of the downhole tool. The downhole tool may be, for example, a packer, a plug (e.g., bridge plug), or an instrument assembly. In implementations, the apparatus can be a pressure housing comprising the hollow profile. In implementations, the apparatus can include a tubular as the hollow profile, and wherein the apparatus includes a metallic liner coupled to the tubular.

Another embodiment is an apparatus including a first tubular and a second tubular both for downhole in a borehole. The first tubular includes a composite of a first ACT (e.g., a first ATSP resin) and reinforcement material (e.g., fibers or particles, or both). The second tubular is a metallic tubular coupled (bonded, joined) to the first tubular via a coating of a second ACT (e.g., a second ATSP resin) on the second tubular. The coating may be applied on a joint tongue of the second tubular.

The term "downhole" may mean inside a well, such as in a borehole or wellbore formed through the Earth surface into a subterranean formation (geological formation) in the Earth crust. Downhole equipment, such as tubulars and downhole tools, may be equipment that is utilized in the borehole or wellbore.

Downhole tools and tubulars are conventionally mostly constructed with metals that can be prone to significant corrosion in the presence of downhole fluids. Hydrogen sulfide ($H_2S$), for example, in downhole fluids can be especially corrosive when aggravated at elevated temperature. In lieu of (or in addition to) $H_2S$, corrosive downhole fluids can include, for example, hydrogen ($H_2$), carbon dioxide ($CO_2$), brines, etc. Embodiments herein of ACT-reinforced composite hollow profiles are generally resistant to $H_2S$, $H_2$, $CO_2$, brines, and water in experiencing less than 6 weight percent loss of mass upon exposure of the ACT-reinforced composite hollow profile to these compounds for one year at 150° C.

Conventional non-metallic composites with thermosetting epoxies are operational at typical downhole temperatures but are thermally stable generally only up to 120° C. for long-term usage. Even high-temperature polymeric systems (e.g., polyimides, bismaleimides, and phenyl-based epoxies) including high-performance thermoplastics [e.g., polyether ether ketone (PEEK) and polyether ketone ketone (PEKK)] have a glass transition temperature less than 150° C.

An increase in the operating envelope (e.g., increased temperature) for polymers that can be utilized for composites in downhole oil-and-gas applications can be beneficial. Embodiments herein disclose ACT (e.g., ATSP) having $T_g$ up to 307° C. utilized as a solution for high-temperature well conditions. This present high-temperature polymeric system of ACT may be beneficial for tubulars and different non-metallic well completion tools including tool mandrels, tool casings, tubing, pressure housings, valve bodies, plugs, and others.

The present disclosure provides for the applicability of ACT (e.g., ATSP) in the oil-and-gas domain. Embodiments provide ACT as a material solution to manufacture hollow profiles as an alternative to metallic and conventional thermoset/thermoplastic materials for composite hollow profiles and tools. Embodiments herein include composite tubulars that can be manufactured from ACT resin with reinforcement (e.g., fiber). The reinforcement can include, for example, carbon, glass, polyamide, etc. The polyamide can be an aromatic polyamide (aramid), such as Kevlar®. The composite tubular as reinforced ACT withstands relatively high downhole temperatures (e.g., up to 300° C.).

Moreover, these ACT composite tubulars can have capability to be joined at higher temperature and pressure with similar or dissimilar materials like a thermoplastic, thermoset, or metallic material. Such can be useful application to join different tubulars in contrast to challenges of relying on adhesively bonded or mechanically threaded joints.

Embodiments utilize ACT to manufacture composite hollow profiles for downhole tools in oil and gas applications. While forming flat composite laminates from ACT resin may be applicable, present embodiments provide for the forming of composite hollow profiles from ACT resin for downhole. Embodiments may utilize prepreg tapes made from ACT resin for filament winding, tape layup and allied processes to manufacture composite hollow profiles (e.g., tubulars, downhole tool components) for downhole applications. Again, in implementations, the ACT composite hollow profiles as tubulars can be joined with similar tubulars or dissimilar tubulars.

The ACT (e.g., ATSP) has both thermoset and thermoplastic behaviors, relatively high operating temperature, and good chemical compatibility. The ACT may be utilized as the matrix and as the binder in a composite structure. The terms "matrix" and "binder" can be synonyms in the context of the present ACT composite.

ACT is a material that can behave as a thermoset (e.g., before processing) and once cured, the ACT can behave like a thermoplastic. Thermoplastic nature in ACT behavior is generally after curing. In implementations, the ACT (e.g., ATSP) prepreg tapes are generally a thermoset prepreg tape. In implementations, the ACT (e.g., ATSP) prepreg tapes are generally a vitrimer prepreg tape. Vitrimers are a class of plastics derived from thermosetting polymers, may be very similar to thermosetting polymers, and may include molecular covalent networks that can change their topology by thermally activated bond-exchange reactions.

As indicated, there can be significant challenges to utilizing non-metallics tools at the elevated temperature environments of downhole. Metallic components are prone to significant corrosion at relatively high temperatures that can be experienced downhole. Conventional thermosetting non-metallic solutions are generally not mechanically durable above 120° C. There are also challenges associated with the joining of tubulars by threaded connections or adhesives. Embodiments herein address these challenges by utilizing ACT material.

Many downhole tools like mandrels, tool casings, tubing, pressure housings, valve bodies, plugs, and others with hollow profiles are metallic while some are non-metallic having a relatively low operation envelope with respect to temperature limiting their use in high temperature, high pressure applications. As discussed, implementations provide ACT composites as replacement material for metal of downhole tools operating in high temperature-high pressure downhole environments. The ACT polymer matrix as a binder/resin can be utilized with different reinforcement materials (e.g., carbon, glass, Kevlar®, hybrid, and others). Towpregs, commingled fibers, and similar constructions can be made from the ACT polymer matrix (e.g., available in powder form). The towpregs can then be employed to manufacture tubulars via filament winding, tape placement and allied processes. Simple hand layup and bladder molding can also be applied to manufacture the tubular from continuous fiber prepregs made from this ACT resin system. The composite tubulars realized through this ACT material system can have capability to withstand relatively high temperatures including in a continuous service temperature of up to 300° C. (and greater), which is significantly higher than typical high-temperature thermoplastic and thermoset resin systems. The composites with ATSP resins can be stable in air to at least 350° C. and stable in nitrogen to at least 425° C. This ACT resin system generally does not thermally degrade at temperatures below 500° C.

FIG. 1 is a well site 100 that includes a wellbore 102 (borehole). Hollow profiles are installed downhole in the wellbore 102. The hollow profiles (e.g., conduits) can be a composite of ACT and filler material (e.g., particles, fibers, etc.). The filler material reinforces the ACT. The filler material can be labeled as reinforcement material. The composite (hollow profile) may have, for example, 10 weight percent (wt %) to 80 wt %, or 10 wt % to 40 wt %, of the filler material (reinforcement material).

A hollow profile is generally a structure having a wall (with a wall thickness) and an interior cavity. The interior cavity is an internal space (volume) congruent with the profile being a hollow profile. The inside surface of the wall may define the interior cavity. The hollow profile shape may enclose the interior cavity (internal space) as a void. The interior cavity may be enclosed (e.g., fully enclosed) by the wall. The interior cavity may be enclosed in a radial direction by the wall but not enclosed at longitudinal ends of the hollow profile. For configurations with the interior cavity partially enclosed in the radial direction, the hollow profile can be labeled as a semi-hollow profile in implementations. The hollow profile may be generally cylindrical with a circular cross section (cutting plane parallel to radial axis and perpendicular to longitudinal axis). On the other hand, a cross section (cutting plane parallel to radial axis and perpendicular to longitudinal axis) of the hollow profile may be, for example, square, rectangular, or irregular.

An apparatus (e.g., a tubular or downhole tool) for use in a borehole may be or include a hollow profile. Examples of a hollow profile for use in a borehole (e.g., wellbore 102) include a tubular, casing (e.g., wellbore casing, tool casing, etc.), tubing (a tube), piping (a pipe), a pressure housing, a valve body, a tool mandrel, and so on. The tubing, piping, pressure housing, valve body (of a valve), tool mandrel, and the like, may be a component of a downhole tool. The downhole tool having the hollow profile as a mandrel may be, for example, a plug (e.g., frac plug, bridge plug, etc.), a packer, a gauge mandrel, and so forth. A pressure housing as the hollow profile may be, for example, for instrumentation or other downhole tools or applications. A host of different downhole tools may incorporate a mandrel, tubing, piping, a valve body, a pressure housing, etc. that is a hollow profile. The downhole tool may be the hollow profile, or the hollow profile may be a component of the downhole tool.

An example of a hollow profile in the wellbore 102 can be the casing 104 (wellbore casing). The casing 104 is a tubular that can be a composite of ACT reinforced with filler material, as discussed. The casing 104 may be multiple tubulars coupled (joined) longitudinally or end-to-end.

An example of a hollow profile in the wellbore 102 can be production tubing 106 installed in the wellbore 102. The production tubing 106 is a hollow profile that is a tubular that can be a composite of ACT and reinforcement material, as discussed. The production tubing 106 may be multiple tubulars coupled (joined) longitudinally or end-to-end.

A downhole tool 108 that is or includes a hollow profile is deployed (installed) in the wellbore 102, and in which the hollow profile includes a composite of ACT and reinforcement material, as discussed. The downhole tool 108 is depicted as the simplified representation of a square for clarity. The downhole tool 108 may be, for example, a plug (e.g., bridge plug), a packer, a gauge mandrel, instrumentation (e.g., having a pressure housing), and the like. The downhole tool 108 may include tubing, piping, a valve, etc.

A component of the downhole tool 108 as a plug, packer, gauge mandrel, or instrumentation (instrumentation assembly) may be a mandrel that is a hollow profile. The downhole tool 108 may be or have a pressure housing as a hollow profile. Downhole tubing and piping (e.g., as a component of or associated with the downhole tool 108) can be a hollow profile. The valve body of a valve may be a hollow profile. Again, the hollow profile may be a composite hollow profile that is a composite of ACT and reinforcement material (e.g., fibers, particles, etc.), such as the composite hollow profile having 10 wt % to 80 wt % of the reinforcement material. The weight percent of the reinforcement material in the ACT composite may be outside this numerical range.

The downhole tool 108 as installed in the wellbore 102 may be permanently set or retrievable, mechanically set, or hydraulically set, or any combinations thereof.

The downhole tool 108 as a plug (e.g., bridge plug) may be set to isolate a lower part of the wellbore 102. The bridge plug may be installed to permanently seal the wellbore 102 or installed temporarily to preform work on or via the wellbore 102. Bridge plugs are downhole tools that can be located in the wellbore 102 and set to isolate the lower part of the wellbore 102 (further downhole). The bridge plug is generally run in hole and set to isolate a lower zone of the wellbore 102 from an upper zone of the wellbore 102. Bridge plugs may be permanent or retrievable, facilitating the lower wellbore to be permanently sealed from production or temporarily isolated from a treatment conducted on an upper zone of the wellbore 102.

A bridge plug can include slips (e.g., mechanical slips), a mandrel, and sealing element (e.g., expandable, elastomer, rubber, etc.). A bridge plug may be run (e.g., run on a wireline or pipes, and/or through a tubing string) and set (e.g., set in casing 104 or tubing 106) to isolate a lower zone of the wellbore 102 while an upper section of the wellbore 102 is tested, cemented, stimulated (e.g., hydraulically fracturing of the subterranean formation 110), produced (e.g., hydrocarbon and/or water produced from the subterranean formation 110 through the wellbore 102), or injected (injection from surface 112 through the wellbore 102 into the subterranean formation 110). The bridge plug may isolate the upper zone from the lower zone, preventing or reducing fluids of the lower zone (downhole of the plug) from reaching an upper zone (uphole of the plug) of the wellbore 102. Again, such isolation may exist while the upper zone (section) is tested, cemented, stimulated, produced, or injected either permanently or temporarily within the wellbore 102.

The downhole tool 108 as a packer may be a device that can be run into the wellbore 102 with a smaller initial outside diameter that then expands externally to seal the wellbore 102. Packers may employ flexible, elastomeric elements that expand. A packer may be a production packer, test packer, isolation packer, etc. A production packer may isolate the annulus (e.g., between the production tubing 106 and the casing wellbore 102 wall) and anchor or secure the bottom of the production tubing string. A retrievable packer may be a type of packer that is run and retrieved on a running string or production string, unlike a permanent production packer that is set in the casing or liner before the production string is run. A typical packer assembly secures the packer against the casing 104 or liner wall, such as by a slip arrangement of the packer, and creates (forms) a hydraulic seal via sealing elements (e.g., an expandable elastomeric element) of the packer to isolate the annulus. Packers are typically classified by application, setting method and possible retrievability. The tool mandrel of the packer (and of the bridge plug, etc.) can be the composite hollow profile, as discussed.

The wellbore 102 is formed through the Earth surface 112 into the subterranean formation 110 in the Earth crust. In the illustrated implementation, the wellbore 102 has the casing 104 and is therefore a cased wellbore. Cement (not shown) may be disposed between the casing 104 and the formation 110 face. The formation 110 face can be considered a wall of the wellbore 102.

Perforations may be formed through the casing 104 (and cement) for entry of fluid (e.g., hydrocarbon, water, etc.) from the subterranean formation 110 into the wellbore 102 to be produced (routed) as produced fluid through the production tubing 106 to the surface 112. The surface equipment 114 may include a wellhead for receipt of the produced fluid. In other implementations, the wellbore 102 can be utilized for injection of fluid from the surface 112 through the wellbore 102 and the perforations in the casing 104 (and cement) into the subterranean formation 110.

The surface equipment 114 can include a hoisting apparatus (e.g., for raising and lowering pipe strings) and a derrick. The surface equipment 114 and equipment deployed in the wellbore 102 can include a wireline, slickline, coiled tubing, tubing string, pipe, drill pipe, drill string, and the like, that facilitates mechanical conveyance for deploying downhole tools (e.g., downhole tool 108 and other tools). The deployment of the downhole tool 108 may include lowering the downhole tool 108 into the wellbore 102 from the surface 112 and setting (e.g., via mechanical slips or other mechanisms) the downhole tool 108 in the wellbore 102. In some implementations, the equipment (e.g., wireline) may provide electrical connectivity, for example, to actuate the downhole tool 108. For example, a packer or plug may be actuated to seal off a portion of the wellbore 102.

Again, the casing 104 may be secured within wellbore 102 by cement (not shown). The casing 104 may be, for example, metal, plastic, composites, and the like, and may be expanded or unexpanded as part of an installation procedure. In implementations, the casing 104 is a composite of ACT and filler material, as discussed. The filler material can be long, short, and/or woven fibers. The filler material can be particulate fillers. The production tubing 106 may be a tubing string utilized in the production of hydrocarbons. The downhole tool 108 may be disposed on or near production tubing 106 in certain implementations.

As mentioned, depending on the type of downhole tool 108, the downhole tool 108 may be permanently set or retrievable, mechanically set, hydraulically set, and/or combinations thereof. When set, the downhole tool 108 if a packer or plug may fluidically isolate the lower part of the wellbore 102 (downhole of the packer or plug) from an upper part of the wellbore (uphole of the packer or plug). When set, the downhole tool 108 as a packer may isolate zones of the annulus between the casing 104 and the production tubing 106 (e.g., a tubing string) by providing a seal (fluid seal) between the production tubing 106 and the casing 104. Again, in examples, a packer if the downhole tool 108 may be disposed on the production tubing 106.

It should be understood by those skilled in the art that present examples are equally well suited for use in wellbores having other directional configurations including vertical wellbore, horizontal wellbores, deviated wellbores, multilateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts an onshore operation, it should be understood by those skilled in the art that the present techniques are applicable for offshore operations. In addition, while FIG. 1 depicts use of the downhole tool 108 in a cased portion of wellbore 102, it should be understood that a downhole tool 108 may also be used in uncased portions (e.g., openhole portions) of wellbore 102.

Figure 2:
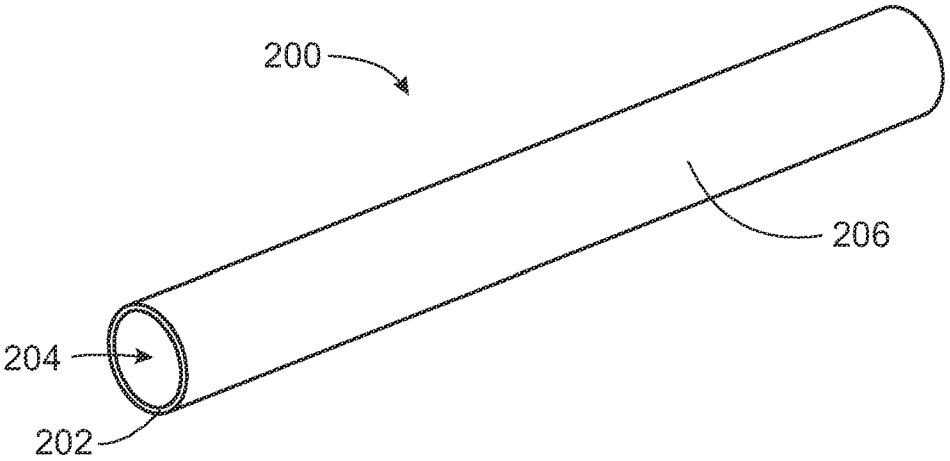
FIG. 2 is a hollow profile for downhole in a borehole.

FIG. 2 is a hollow profile 200 for downhole in a borehole (e.g., wellbore 102 of FIG. 1). The hollow profile 200 is a structure having a wall 202 and an interior cavity 204. The interior cavity 204 is an internal space (volume) consistent with the profile being hollow. The hollow profile 200 shape may enclose the interior cavity 204 (internal space) as a void. In the illustrated implementation, the interior cavity 204 is enclosed by the wall 202 in the radial direction, but open at the longitudinal ends of the hollow profile 200. The inside surface of the wall 202 defines the interior cavity 204. The outside surface of the wall 202 is the exterior surface 206 of the hollow profile 200.

The hollow profile 200 may have a radial cross section that is circular (as depicted), square, rectangular, irregular, and so forth. A radial cross section is with the cutting plane (for the cross-section view) parallel to the radial axis and perpendicular to the longitudinal axis. The hollow profile 200 may be cylindrical (as depicted) with a circular radial cross section, or approximating cylindrical with a radial cross section that is generally or substantially circular. The wall thickness of the wall 202 can vary along the longitudinal length of the hollow profile 200, depending on the implementation. In examples, the hollow profile 200 as generally depicted can be, for instance, a tubular (for downhole) or a downhole pressure housing, and the like. The hollow profile 200 can be a component (e.g., mandrel, etc.) of a downhole tool, though may have a varying wall 202 thickness, not be as closely cylindrical, have step changes in the profile (exterior and interior), have irregular portions, and so on.

The hollow profile 200 can be a composite (a composite hollow profile). As discussed, the hollow profile 200 can be a composite of ACT and filler material such as fibers. The ACT (e.g., ATSP) came utilized as a matrix or a binder material in the composite to increase the temperature resistance compared to conventional matrix/binder materials. The ACT composite with fibers as the hollow profile 200 (e.g., a tubular, conduit, tube, generally cylindrical, etc.) can be wound in a direction to achieve anisotropic properties beneficial for operating under a set of loading conditions. Similarly, the fibers as continuous fibers can be laid in random fiber orientations and hand layup, or bladder molding can be utilized to manufacture the hollow profile 200, and the like.

The ATSP matrix has relatively high $T_g$. The $T_g$ may be measured, for example, by differential scanning calorimetry (DSC). In examples, the measurement of an ATSP polymer composite via a DSC gives an endothermic peak at 332° C. corresponding to melting temperature ($T_m$), and a shoulder at 307° C. corresponding to the $T_g$. In contrast, a PEEK DSC curve measured showed a double melting behavior with a lower endothermic peak at 212° C. and a higher endothermic peak at 341° C., and with the PEEK $T_g$ measured as 155° C. In examples, a composite of ATSP and carbon demonstrates thermal resistance with a mass loss of 1.33% or less, corresponding to a $T_g$ of 307° C., which is generally not possible for conventional thermosetting epoxies.

The $T_g$ of ATSP can be in the ranges of 150° C. to 307° C., 170° C. to 307° C., 239° C. to 307° C., 253° C. to 307° C., and 267° C. to 307° C. Table 1 shows example properties of different resin systems. Density is given in grams per cubic centimeter (g/cm$^3$). Tensile strength is given in megapascal (MPa). Tensile modulus is given in gigapascal (GPa). The values of properties given for ATSP in Table 1 are examples and not meant to limit the present techniques.

TABLE 1

Properties of high temperature PEEK, Epoxy and ATSP

| Resin | Density (g/cm$^3$) | Tensile Strength (MPa) | Tensile Modulus (GPa) | Glass Transition Temperature (° C.) |
|---|---|---|---|---|
| PEEK | 1.3 | 100-110 | 4.5 | 155 |
| Epoxy | 1.2 | 70-90 | 2.9 | 80-120 |
| ATSP | 1.32 | 95 (range 60-107) | 2.5-4.2 | 150-307 |

In implementations, the ATSP $T_m$ being 332° C. may mean for application of that ATSP the downhole operating temperature should be less than 332° C., even though ATSP resins are generally stable in air to at least 350° C. and in nitrogen to at least 425° C., and does not thermally degrade at temperatures below 500° C.

ATSP is a material that is generally continuously amorphous but can have liquid crystal segments. ATSP can give a hybrid of properties. In particular, ATSP can have combined properties that include both typical thermoset properties and additionally thermoplastic properties. In post curing of the ATSP after the crosslinking, the ATSP (including ATSP composites) may behave as a thermoplastic and receptive to being thermoformed, joined, welded, recycled, and the like. Another example of a material that behaves as hybrid thermoset/thermoplastic is VITRIMAX™ (by Mallinda Inc. of Denver, Colorado, USA) that is a polyimine-based vitrimer (not a polyester). VITRIMAX T130™ has a low $T_g$ (130° C.) like conventional thermosets.

Figure 3:
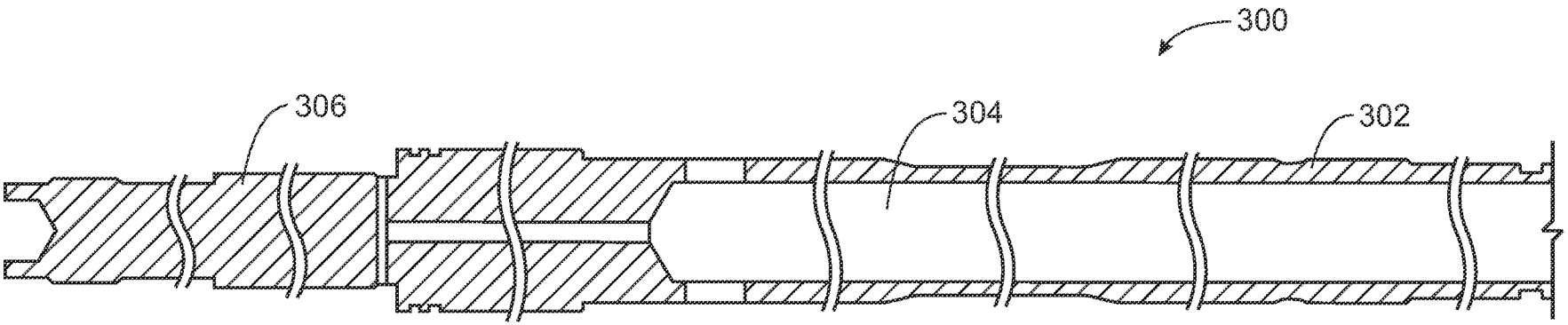
FIG. 3 is a diagram of an example of a hollow profile that is a tool mandrel for a downhole tool that is an example bridge plug.

FIG. 3 is an example of a hollow profile 300 that is a tool mandrel for a downhole tool that is an example bridge plug. The hollow profile 300 (example tool mandrel) can be a composite of ACT and filler material. The depicted hollow profile 300 for an example bridge plug is given only as an example. Hollow profiles as a tool mandrel that can be composite of ACT and filler material are applicable for other bridge plugs and for other downhole tools that are not a bridge plug.

In the illustrated embodiment, the hollow profile 300 is generally cylindrical (a radial cross-section that is generally circular). The hollow profile 300 as a mandrel for a bridge plug is utilized in a borehole (wellbore). The depicted view is a cross section (longitudinal cross section) with the cutting plane parallel to the longitudinal axis.

The hollow profile 300 has a wall 302 and an internal cavity 304. The wall 302 varies in wall thickness along the longitudinal length of the wall 302. In other words, the wall 302 varies in wall thickness along the longitudinal length of the tool mandrel. The hollow profile 300 structure has a solid portion 306 with no internal cavity in a radial direction.

Figure 4:
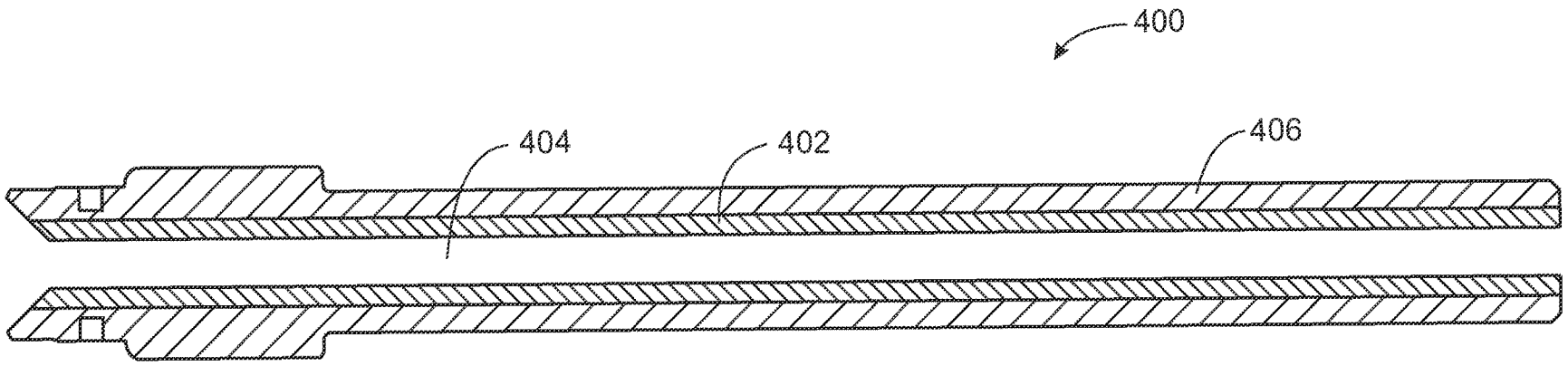
FIG. 4 is a diagram of an example mandrel configuration of a downhole tool.

FIG. 4 is an example mandrel configuration 400 of a downhole tool. In this implementation, the downhole tool is an example frac plug. The illustrated mandrel configuration 400 includes a hollow profile 402 (having an internal cavity 404) as an inner mandrel and a hollow profile 406 as an outer mandrel. The outer mandrel (hollow profile 406) may be formed on the inner mandrel (hollow profile 402). The hollow profiles 402, 406 may each be a composite of ACT and filler material, as discussed. The hollow profiles 402, 406 are each generally cylindrical (a radial cross-section that is generally circular). The hollow profiles 402, 406 as together in combination may be considered a single hollow profile having the internal cavity 404. As indicated, the example mandrel configuration 400 is for an example frac plug utilized in a borehole (wellbore). The depicted view is a longitudinal cross section.

A challenge for conventional hollow profiles as tubulars (and for downhole tools) can be the threaded joint connections for metal tubulars and that thermosetting epoxy composite tubulars are adhesively joined. These joint techniques can be manually intensive, require skilled labor, and be susceptible to leakage.

Embodiments herein utilize ACT (e.g., ATSP) as a coating material on a metallic tubular (or metallic tool) to join the metallic tubular (or metallic tool) with a composite tubular made with ACT. To join the metallic tubular with the ACT composite tubular via the ACT coating on the metallic tubular, heat and pressure may be applied to the ACT coating. ATSP having relatively high $T_g$ facilitates this coating application for joining tubulars. ATSP generally has the highest $T_g$ (or among the highest $T_g$) of polymeric coatings available commercially. For instance, ATSP has a greater $T_g$ than polyvinylidene difluoride (PVDF), Lumiflon® fluoropolymer resins, silicones, triglycidyl isocyanurate (TGIC)/polyester, PEEK, fusion bonded (FB) epoxy, and Novalac epoxies.

Figure 5A:
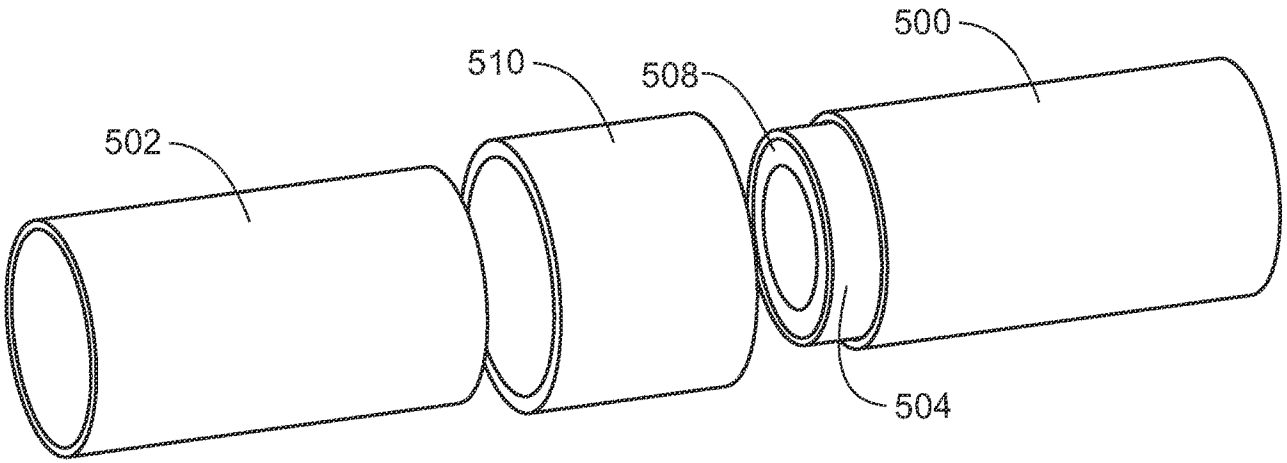
FIG. 5A, FIG. 5B, and FIG. 5C are diagrams of an assembly having a metallic tubular and the ACT composite tubular to be joined.
Figure 5B:
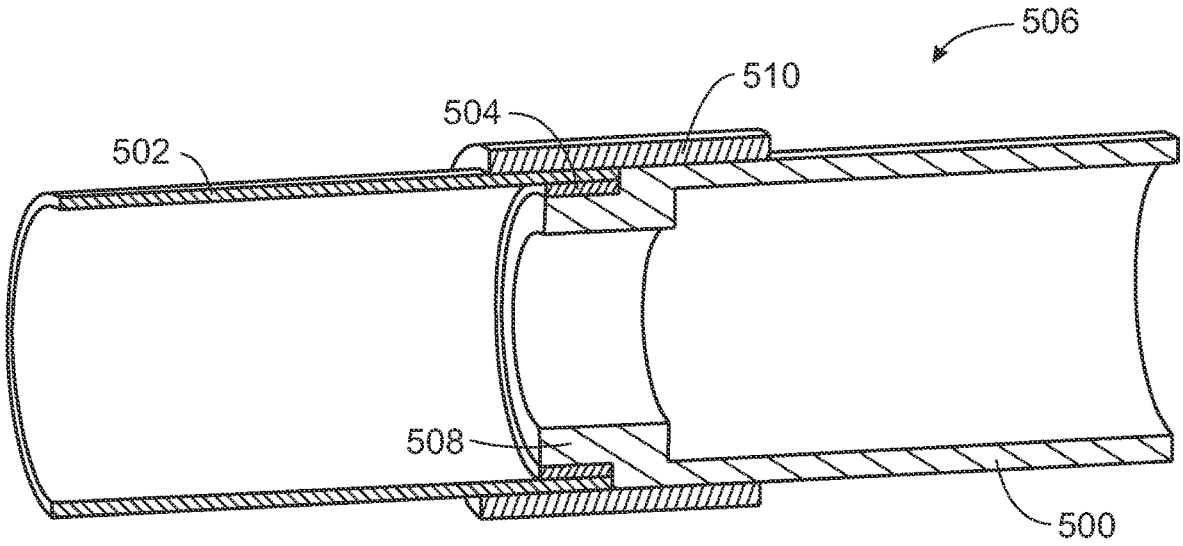
Figure 5C:
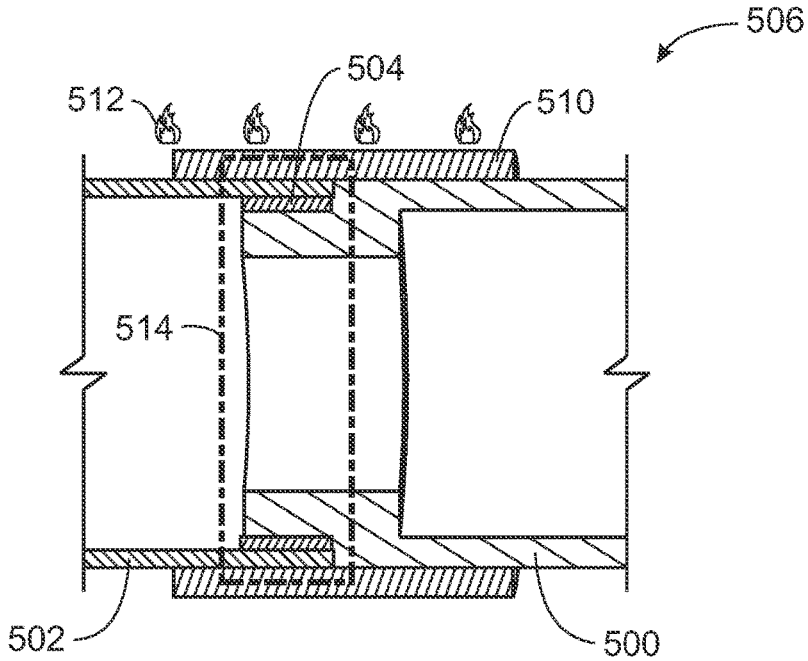

FIGS. 5A-5C are example depictions of joining a metallic tubular 500 with an ACT composite tubular 502 via an ACT coating 504 applied on the metallic tubular.

FIG. 5A is an exploded view of an assembly 506 having the metallic tubular 500 and the ACT composite tubular 502 to be joined. The metallic tubular 500 has a tongue 508 (e.g., joint tongue) to be inserted into the ACT composite tubular 502. In the illustrated implementation, the tongue 508 has the same inside diameter as the remainder of the metallic tubular 500 but a smaller outside diameter than the remainder of the metallic tubular 500. The ACT coating 504 is applied to the outside diameter surface of the tongue 508. A clamping tool 510 is utilized to facilitate joining the metallic tubular 500 to the ACT composite tubular 502.

FIG. 5B is the assembly 506 of FIG. 5A but with the tongue 508 inserted into the inside diameter of the ACT composite tubular 502. A cutaway view of the assembly 506 is depicted. Insertion of the tongue 508 engages (mates) the metallic tubular 500 with the ACT composite tubular 502. In some implementations, the ACT composite tubular 502 may have a groove (not shown) on its inside diameter to facilitate receipt of the tongue 508.

As shown in FIG. 5B, the ACT coating 504 rests between the inside diameter of the ACT composite tubular 502 and the outside diameter of the tongue 508. Pressure may be applied to the outside surface of the ACT composite tubular 502 via the clamping tool 510 to press the ACT coating 504 between the ACT composite tubular 502 and the tongue 508 to promote forming a bond with the ACT coating 504.

FIG. 5C is the assembly 504 with a representative depiction of heat 512 being applied through the clamping tool 510 to the ACT coating 504 to promote forming a bond of the ACT composite tubular 502 to the metallic tubular 500 via the ACT coating 504. The interface of the ACT composite tubular 502 with the tongue 508, and the ACT coating 504 there between, may be labeled as a fusion zone 514. Again, the heat 512 and pressure applied through the clamping tool 510 may bond or fuse the ACT composite tubular 502 to the tongue 508 via the ACT coating 504.

The heat 512 can be applied, for example, with a conduction heater, convection heater, ultrasonic heater, infrared heater, eddy current heater, and/or laser, and the like. The amount of applied pressure, and the specified temperature of the fusion zone 514 by application of the heat 512, may depend on the particular type or formulation of the ACT coating 504. The specifying of applied pressure and temperature may be tailored, for example, based at least in part on the $T_g$ of the ACT coating 504.

In implementations, the ACT coating 504 can provide to bond and debond (reversible bonding), which can facilitate to debond a connection of a tubular from another tubular. ATSP has demonstrated good bonding of metal and ACT composites with the failure mode mostly a cohesive failure with relatively high shear strength at high and low temperatures. This can be relevant to bonding and debonding.

As indicated, reinforcement material to manufacture the composite tubular can be particles (e.g., carbon, glass, etc.) or fibers. The fibers can be carbon fibers, glass fibers, aramid fibers (e.g., Kevlar® fibers), basalt fibers, natural fibers, etc., or any combination of these fibers as reinforcement materials. The ACT can be the matrix material to make, for example, a unidirectional vitrimer prepreg with post cured thermoplastic characteristics (e.g., in the forms of sheets or tapes, or a towpreg) and in which the ACT acts as the resin system. "Prepreg" is a common term for a reinforcing fabric which has been pre-impregnated with a resin system. A prepreg may mean "fiber pre-impregnated with resin."

Prepregs can be utilized to form (manufacture) composites (e.g., structural composites). Herein, in context of ACT vitrimer prepreg, vitrimer are a class of plastics, which are derived from thermoset polymers and are very similar to thermoset polymers, and may include molecular covalent networks that can change their topology by thermally activated bond-exchange reactions.

A prepreg is generally fiber material (e.g., woven or unidirectional fibers) impregnated with matrix material (e.g., a resin). The prepreg is typically formed before application to manufacture a product with the prepreg. Therefore, impregnated fibers in the prepreg (e.g., formed well before application of the prepreg) may be called pre-impregnated.

ACT is applicable as the resin for the prepreg as a vitrimer prepreg. Because of vitrimer behavior of ACT (e.g., ATSP), the ACT (even though a thermoset) can act as the matrix material in what can be labeled as a vitrimer prepreg. Thermoplastic behavior can be resins that soften or become moldable on heating and harden on cooling, and are able to repeat these processes.

ACT vitrimer prepregs have fibers (e.g., woven, non-woven, knitted, stitched, braided, wound, etc.) and can be in the form, for example, of sheets or tapes, or other forms. In implementations, the fibers may generally be continuous fibers. The prepreg (e.g., in form of sheets or tapes) may be unidirectional fibers (most or all fibers running the same direction) impregnated with a resin matrix. Filament winding may be employed to form composite structures from the prepreg.

A towpreg (also called tow prepreg) is a form of prepreg (e.g., generally having continuous fibers). Towpreg is tows of fiber pre-impregnated with resin. Towpreg is commonly utilized in filament winding applications. Towpreg material can be essentially a continuous prepreg composite and can have a relatively high filament count. Towpreg winding may utilize a fiber tow that is pre-impregnated with resin (prepreg). For unidirectional tape, individual tows may aligned and then spread to form an impregnated unidirectional tape. For woven, individual tows may woven together to form a fabric before impregnation. For non-woven, tows may be arranged in a non-woven mat before impregnation.

Filament winding is a composite manufacturing technique that can involve applying filament tows (e.g., glass fibers, carbon fibers, etc.) onto a mandrel. The filament layers may be cross plied to achieve the strength characteristics determined by the part designer. The applied tows can be combined with a resin matrix immediately prior to application to the mandrel (wet winding) or the tows can be a prepreg or towpreg which is the fiber/resin combination typically made well before application.

Implementations may form a composite structure (e.g., a fully composite structure) with no liner, or a hybrid composite structure (composite structure with metallic liner). The metallic liners (e.g., if employed as coupled to the composite structure) can be, for example, steel, titanium, alloys (e.g., superalloys), or other metals.

Different manufacturing techniques can be utilized to make the ACT composite. The ACT composite formed as a hollow profile can be a tubular or a component for a downhole tool. An example manufacturing technique that can be utilized to make the tubular profiles is filament winding. Other manufacturing techniques, such as tape placement or bladder molding, can also be used to manufacture the composite tubular profile. The ACT composite as a hollow profile can be formed, for example, by filament winding or bladder molding.

For tape placement, a tape (e.g., a single tape) may passed through the feed rollers with a predefined tension and feed rate. The tape placement for composites (e.g., thermoplastic composites) may involve heating, melting, and cooling. An incoming composite tape may be bonded to a previously laid and consolidated laminate under heat and pressure locally applied to the interface. By laying additional layers in different directions, a part with desired thickness and properties can be fabricated. An example of tape placement is automated tape placement (ATP) composite manufacturing. In examples, the fiber placement process automatically places multiple individual pre-impregnated tows onto a mandrel at relatively high speed, employing a numerically controlled placement head to dispense, clamp, cut and restart each tow during placement. Tape laying is with prepregged tape, rather than single tows, laid down (e.g., continuously) to form parts.

Bladder molding is a manufacturing technique for composite parts (e.g., hollow composite parts). In bladder molding, a composite material may be applied to a bladder and the part inserted into a female cavity mold. A press may clamp the mold shut and heat applied to cure the part. Applied air pressure can force the laminate outward in the cavity, consolidating the material in the closed mold. The bladder may be removed after cure and the remaining end product is a hollow structure.

The bladder molding may begin with fibers (e.g., sheets of fibers) impregnated with ACT and that can be a prepreg. The prepreg sheets may be wrapped around an inflatable bladder, and then placed inside the mold cavity and the mold closed. Once the mold is closed, the mold may apply pressure to the inside of the bladder. Pressure may cause the bladder to expand and push on the resin-filled fibers. The pressure pushes outward against the inside of the mold cavity. Then, heat may be applied to the mold to solidify the part, or also known as curing. The component fibers form in the shape of the inside the mold cavity. Once cured, the mold may be opened, revealing the hardened hollow part, and the bladder may be removed from the inside.

Figure 6:
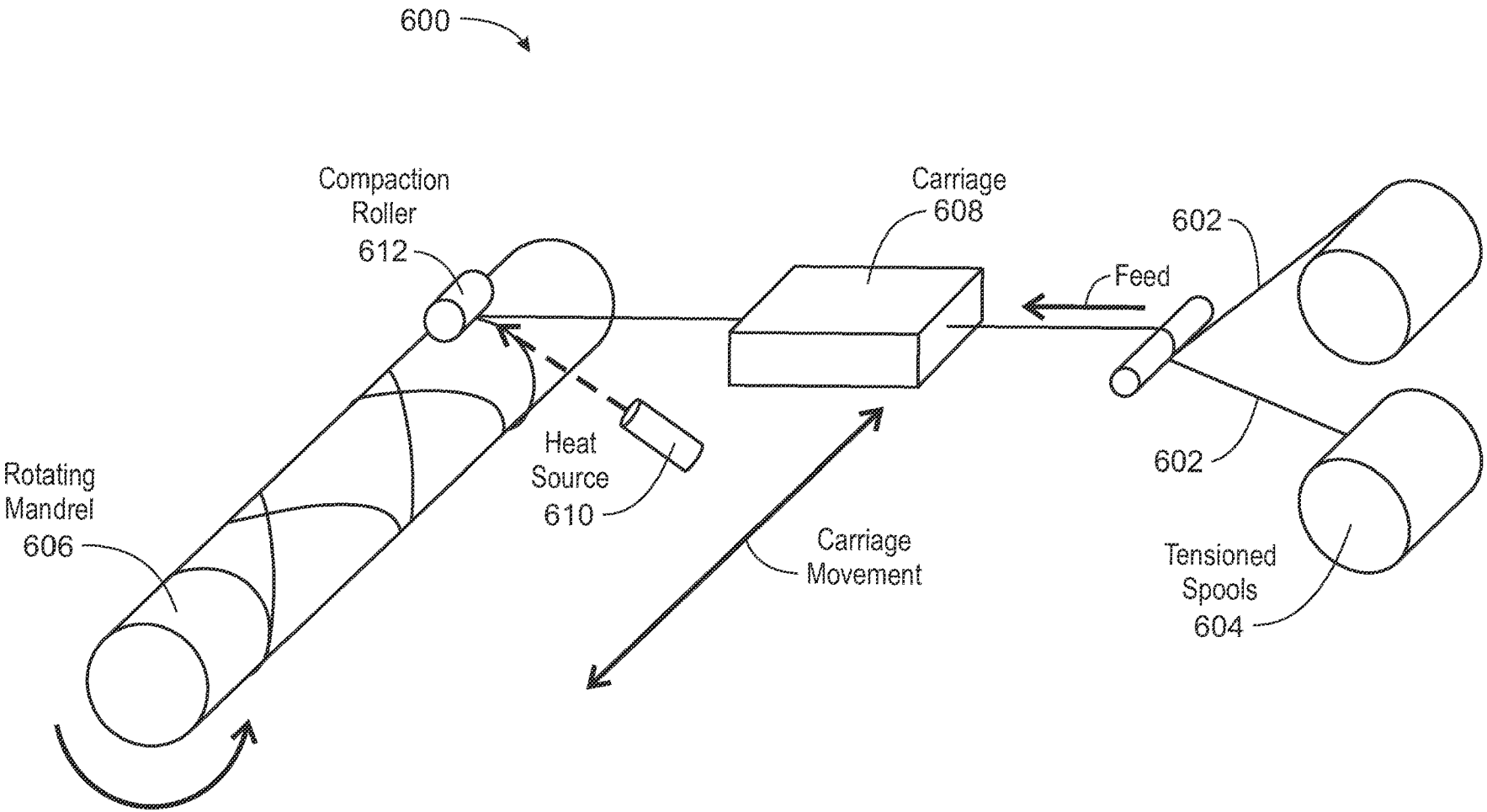
FIG. 6 is a diagram of a filament winding system.

FIG. 6 is a filament winding system 600. Filament winding can be employed to manufacture the ACT composite hollow profile (e.g., tubular) with, for example, prepreg tapes or towpregs. The fiber angles can be varied to produce tailored laminates to meet a range of loads requirement for a particular product. In embodiments, the product of the filament winding may be an ACT composite hollow profile that can be a tubular or for a downhole tool, and the like.

The feed 602 can include fibers impregnated with ACT resin, such as in the form of prepreg tapes or towpregs. As discussed, the fibers can include, for example, glass fibers, carbon fibers, aromatic polyamide fibers (e.g., Kevlar fibers), and/or other fibers. The feed 602 (ACT-impregnated fibers) can be fed, for example, from tensioned spools 604. The ACT-impregnated fibers can be wound on a rotating metallic mandrel 606 to manufacture an ACT composite (fiber-reinforced) as a hollow profile. The filament winding system 600 may include a carriage 608 that facilitates guiding the winding in the forming of the ACT composite hollow profile on the rotating mandrel 606. In examples, no additional pressure is typically implemented for compaction because of the tension maintained on the fibers/tapes during the filament winding. The ACT composite formed as hollow profile on the mandrel 606 can be cured, for example, in an oven or autoclave, or similar equipment, after the winding is completed. The peak cure temperature may be, for example, in the range of 250° C. to 350° C., or in the range of 270° C. to 330° C. The cure time (e.g., the time of the ACT composite hollow profile in the over or autoclave) may be, for example, in the range of 60 minutes to 240 minutes.

While conventional filament winding can be utilized, in-situ consolidation using a heat source 610 (e.g., conduction heater, convection heater, ultrasonic heater, infrared heater, eddy current heater, or laser) and a compaction roller 612 can also be relied on to apply heat and pressure, respectively. The heat source 610 may apply heat to the ACT-impregnated fiber being wound onto the rotating mandrel 606. The compaction roller 612 may apply pressure to the ACT-impregnated fiber being wound onto the rotating mandrel 606. In implementations, this application of heat and pressure can provide for substantially uniform impregnation and facilitate more control of the fiber volume fraction. Thus, the filament winding system 600 may include heat source 610 and the compaction roller 612 that facilitate forming of the ACT composite hollow profile on the rotating mandrel 606.

A hybrid metal-composite tubular may be formed. For instance, a metal liner may be placed on the rotating mandrel 606 and the ACT composite hollow profile formed on the cylindrical metal liner on the rotating mandrel 606.

On the other hand, a full composite tubular (no liner) can be made by demolding the composite hollow profile (tube) from the metallic mandrel 606. A release agent may be applied on the metal mandrel 606 or a low friction film [e.g., polytetrafluoroethylene (PTFE)] is first wrapped on the mandrel 606, and the ACT impregnated fibers are wound over the release agent or low friction film on the rotating mandrel 606. This can facilitate an easier demolding.

Embodiments herein provide for hollow profiles that are a composite of ACT and filler material or reinforcement material (e.g., fibers, particles, etc.). The ACT can have a $T_g$ up to 307° C., e.g., in the range of 267° C. to 307° C., and in which the ACT and the ACT composite hollow profile can withstand temperatures up to 350° C., e.g., in the ranges of 300° C. to 350° C., or 320° C. to 350° C. The ACT generally does not thermally degrade at temperatures below 500° C. Embodiments include tubulars and downhole tools that include ACT, and other similar applications that include ACT. The ACT polymer or resin system has a relatively high $T_g$ and thermal stability and is included herein as a matrix and binder material for fiber-reinforced composite hollow profiles for use as a downhole tubular or component of a downhole tool.

Embodiments include reinforced ACT with fiber reinforcement. The fiber reinforcement can give improved mechanical properties. As discussed, the fiber reinforcement may be, for example, glass fiber reinforcement and/or carbon fiber reinforcement. Aramid fiber (e.g., Kevlar™ fiber) reinforcement and other fiber reinforcement are also applicable. The sealing element (seal or backup) may include reinforcement material including fibers that are mixed with or dispersed in the ACT to reinforce the ACT. Further, embodiments include ACT bonded tubulars, as discussed with respect to FIGS. 5A-5C.

Material selection as the ACT composite is a consideration for effective use of downhole tubulars and downhole tools in oil and gas applications. The hydrocarbon production is often in high pressure and high temperature scenarios. The exposure to high temperature and high pressure may benefit from material systems (e.g., ACT) that have ability to withstand the demanding environment.

The oligomers crosslinked to give the ACT may be initially formed, for example, by reacting precursor monomers 1,4-phenylene diacetate (HQDA), [1,1'-biphenyl]-4,4-acetoxybenzoic acid (ABA), trimesic acid (TMA), and/or isophthalic acid (IPA) into crosslinkable low-molecular weight oligomers.

In particular implementations, ACT may be produced by a two-part oligomerization process wherein branched aromatic crosslinkable copolyester oligomers are synthesized in a melt with average molecular weights between 1000 and 2000 gram per mole (g/mol) with monomer feed ratios selected such that the oligomers preferentially are capped with either carboxylic acid or acetoxy functional groups. These are synthesized with an initial feed of TMA, ABA, IPA, and biphenol diacetate (BPDA). As an example, an oligomer structure designated "CB" (carboxylic acid-capped) oligomers can be synthesized by melt-condensation of TMA, ABA, IPA and BPDA (molar ratio 1:3:2:2, respectively). "AB" (acetoxy-capped) oligomers can be synthesized similarly with a molar ratio 1:3:0:3.

In implementations, the ACT may be [1] an aromatic thermosetting copolyester comprising a first oligomer having a carboxylic acid end group and a second oligomer having an acetoxy end group, wherein the ratio of carboxylic acid end groups to acetoxy end groups is greater than 1:1, and wherein the first and second oligomers are both formed from at least four monomers and wherein one of the at least four monomers in both the first and second oligomers is biphenol diacetate (BPDA), and/or [2] an aromatic thermosetting copolyester having a first oligomer with a carboxylic acid end group and a second oligomer with an acetoxy end group, wherein the ratio of carboxylic acid end groups to acetoxy end groups is less than 1:1, and wherein the first and second oligomers are both formed from at least four monomers and wherein one of the at least four monomers in both the first and second oligomers is BPDA. The ACT is formed by crosslinking the oligomers.

A feature of ATSP as a cross-linked aromatic copolyester can be ability to undergo further processing in the solid state through interchain transesterification reactions. ATSP can be characterized as a vitrimer. Vitrimers are a class of plastics, which are derived from thermosetting polymers (thermosets) and are very similar to them. Vitrimers may include molecular covalent networks that can change their topology by thermally activated bond-exchange reactions. Thus, vitrimers may be crosslinked polymers featuring dynamic covalent chemistry which allows changes in network topology via thermally-driven bond exchange. Subsequent process operations after cure may be mediated by a bond exchange reaction, which normally have a fixed topology. However, when heated above their $T_g$, a transition from viscoelastic solid to viscoelastic liquid may be realized, facilitating thermoplastic-like processing, such as compression, injection, extrusion, casting, and laminated molding.

The ACT vitrimer (e.g., ATSP) utilized as resin for a downhole composite hollow profile can be carboxylic acid cured, anhydride cured, etc. The ACT vitrimer may be carboxylic acid cured or anhydride cured, or both. Based on the immersion test in water at room temperature (25° C.) and at the elevated temperature (93° C.), ACT vitrimer to be used in manufacturing a hollow profile for downhole tool shows little degradation in 7 days. For instance, based on the immersion test in water for 7 days at elevated temperature (93° C.), carbon-filled ACT vitrimer composite for a downhole hollow profile (e.g., tubular or downhole tool) shows little degradation or swelling in having less than 8% change in mass and volume. As indicated, ACT vitrimer as a material of construction (resin) in the manufacture of composite hollow profiles as a downhole tubular or for a downhole tool has a glass transition temperature of more than 150° C.

In implementations, ACT vitrimer (e.g., as a resin or polymer in the hollow profile) has a tensile strength of greater than 60 MPa (e.g., in the range of range 60 MPa to 107 MPa), a tensile modulus greater than 2.5 GPa (e.g., in the range of 2.5 GPa to 4.2 GPa), and an elongation at break of at least 1.5% (e.g., in the range of 1.5% to 2.5%). The tensile strength, tensile modulus, and elongation at break can be measured, for example, per American Society for Testing and Materials (ASTM) standard D638 [D638-22 or D638-14] "Standard Test Method for Tensile Properties of Plastics" (last updated Jul. 21, 2022) of ASTM international, or International Organization for Standardization (ISO) 527-2: 2012 "Plastics—Determination of tensile properties—Part 2: Test conditions for moulding and extrusion plastics" (published 2012-02) last reviewed and confirmed in 2017.

ACT vitrimer for a hollow profile as a downhole tubular and/or for a downhole tool will generally does not degrade in bases or alkali solutions having pH less than 13 for 7 days at room temperature and at elevated temperature of 93° C. ACT vitrimer for hollow profiles for tubular and/or downhole tool experiences little degradation in 10% hydrochloric acid (HCl) for 7 days at room temperature. ACT vitrimer to be used in manufacturing hollow profile as a tubular and/or for downhole tool will minimally degrade in presence of 30% hydrogen peroxide at room temperature.

While the current disclosure focuses on how to effectively use ACT resin to manufacture and join tubulars, implementations can further extend to apply the ACT binder and coating in sand screens, frac balls, backup shoes, and other downhole applications. Also, metallic components/mandrel can be coated with ACT resin coating material and then overwrapped with the ACT composite layers to manufacture a hybrid tubular.

While the current disclosure discusses filament winding as a technique to use this ATSP resin to manufacture the tubulars, other applicable techniques include automated tape placement, bladder molding, hand-layup, compression molding, extrusion molding, and pultrusion. The composite tubulars can be manufactured with fiber yarns or tapes pre-mixed or post-mixed with different fillers. The fillers may include, for instance, micro-fillers (particles or microtubes) and nanofillers (particles or nanotubes), such as carbon black, graphite, graphene, glass, silica, mica, pigment, or other nanotubes to improve mechanical properties, chemical resistance properties, flowability of the composite, conductivity and other attributes.

Furthermore, welding techniques (e.g., induction, resistance, friction, ultrasonic and others) may be employed to weld different tubulars (metal to ATSP based composite). The same is true for the joining multiple ATSP composite tubulars as well. Moreover, ATSP may also be utilized as the glue joining (between) composite pipes in that the pipes can be pushed together and the ATSP cures to give a thermoplastic-like bond for the jointed pipe.

While the discussion herein has focused on ACT vitrimer (e.g., ATSP) as a resin or polymer for the resin matrix (binder) in a composite hollow profile for downhole, other vitrimers can be applicable in implementations as resin in a composite hollow profile for downhole. Such vitrimers may include, for example, acetal epoxy based vitrimer, Schiff base epoxy vitrimer, disulfide based vitrimer, polyhexahydrotriazine (PHT) based vitrimer, boronic ester based vitrimer, benzoxazine based vitrimer and other vitrimers.

In view of the foregoing, the present disclosure may provide composite hollow profiles that include an ACT or other vitrimers. The methods, systems, and tools may include any of the various features disclosed herein, including one or more of the following statements.

Statement 1. An apparatus comprising a hollow profile for downhole in a borehole, the hollow profile comprising a composite of an aromatic copolyester thermoset (ACT) and a reinforcement material, wherein the reinforcement material comprises fibers or particles, or both.

Statement 2. The apparatus of Statement 1, wherein the ACT comprises an aromatic thermosetting copolyester (ATSP) resin.

Statement 3. The apparatus of Statement 1 or 2, wherein the reinforcement material comprises fibers.

Statement 4. The apparatus of any preceding Statement, wherein the fibers comprise carbon, glass, aramid, boron, basalt, metal, polyethylene, polypropylene, poly(p-phenylene-2,6-benzobisoxazole) (PBO), or natural fibers, or any combinations thereof, and wherein the natural fibers comprise flax or jute, or both.

Statement 5. The apparatus of any preceding Statement, wherein the apparatus is a tubular.

Statement 6. The apparatus of any one of Statement 1 to 4, wherein the apparatus is a downhole tool.

Statement 7. The apparatus of Statement 6, wherein the downhole tool comprises the hollow profile as tubing, piping, a pressure housing, a valve body, or a tool mandrel, or any combinations thereof.

Statement 8. The apparatus of claim Statement 6, wherein the downhole tool comprises a mandrel comprising the hollow profile.

Statement 9. The apparatus of Statement 6 or 8, wherein the downhole tool is a packer, a plug, or an instrument assembly.

Statement 10. The apparatus of Statement 6, wherein the apparatus comprises a pressure housing comprising the hollow profile.

Statement 11. The apparatus of any one of Statement 1 to 4, wherein the apparatus comprises a tubular as the hollow profile, and wherein the apparatus comprises a metallic liner coupled to the tubular.

Statement 12. The apparatus of any preceding Statement, wherein the ACT comprises an ACT vitrimer.

Statement 13. The apparatus of Statement 12, wherein the ACT vitrimer is carboxylic acid cured or anhydride cured, or both.

Statement 14. The apparatus of Statement 12 or 13, wherein the ACT vitrimer comprises a tensile strength of at least 60 megapascal (MPa), a tensile modulus of at least 2.5 gigapascal (GPa), and an elongation at break of at least 1.5%.

Statement 15. An apparatus comprising: a first tubular for downhole in a borehole, the first tubular comprising a composite of a first aromatic copolyester thermoset (ACT) and reinforcement material, wherein the reinforcement material comprises particles or fibers, or both; and a second tubular that is a metallic tubular coupled to the first tubular via a coating of a second ACT on the second tubular.

Statement 16. The apparatus of Statement 15, wherein the first ACT comprises a first aromatic thermosetting copolyester (ATSP) resin, and wherein the second ACT comprises a second ATSP resin.

Statement 17. The apparatus of Statement 15 or 16, wherein the coating is on a joint tongue of the second tubular.

Statement 18. A method comprising installing an apparatus in a borehole, wherein the apparatus comprises a hollow profile comprising a composite of an aromatic copolyester thermoset (ACT) and a reinforcement material comprising fibers, wherein the apparatus is a downhole tool or a tubular.

Statement 19. The method of Statement 18, wherein the ACT comprises an aromatic thermosetting copolyester (ATSP) resin.

Statement 20. The method of Statement 18 or 19, wherein the hollow profile is formed by filament winding or bladder molding, and wherein the hollow profile comprising the composite comprises 10 weight percent (wt %) to 80 wt % of the fibers.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

The present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An apparatus comprising:

a hollow profile for downhole in a borehole, wherein the hollow profile is a filament-wound composite of an aromatic copolyester thermoset (ACT) vitrimer and continuous fibers impregnated with the ACT vitrimer, wherein the ACT vitrimer of the filament-wound composite is cured ACT vitrimer that is a cross-linked network reprocessable by dynamic bond exchange, wherein the composite is resistant to compounds including hydrogen sulfide, hydrogen, carbon dioxide, brines, and water in experiencing less than 6 weight percent loss of mass upon exposure of the composite to the compounds for one year at 150° C., and wherein the ACT vitrimer comprises a tensile strength of at least 60 megapascal (MPa), a tensile modulus of at least 2.5 gigapascal (GPa), and an elongation at break of at least 1.5%.

2. The apparatus of claim 1, wherein the ACT vitrimer comprises an aromatic thermosetting copolyester (ATSP) resin comprising an aromatic polyester backbone, and wherein the continuous fibers are glass fibers.

3. The apparatus of claim 1, wherein the filament-wound composite comprises the continuous fibers impregnated with the ACT vitrimer wound in a predetermined direction in the filament-wound composite.

4. The apparatus of claim 3, wherein the ACT vitrimer comprises an aromatic polyester backbone, and wherein the continuous fibers wound in the predetermined direction in the filament-wound composite comprises predetermined fiber angles.

5. The apparatus of claim 1, wherein the continuous fibers comprise glass, aramid, boron, basalt, metal, polyethylene, polypropylene, poly(p-phenylene-2,6-benzobisoxazole) (PBO), or natural fibers, or any combinations thereof, and wherein the natural fibers comprise flax or jute, or both.

6. The apparatus of claim 1, wherein the apparatus is a downhole tubular configured for use downhole in the borehole, or wherein the apparatus is a casing or a production tubing each comprising multiple tubulars joined longitudinally end-to-end as the hollow profile.

7. The apparatus of claim 1, wherein the apparatus is a downhole tool comprising the hollow profile as tubing, piping, a pressure housing, a valve body, or a tool mandrel, or any combinations thereof.

8. The apparatus of claim 1, wherein the filament-wound composite comprises the continuous fibers impregnated with the ACT vitrimer wound in a predetermined direction in the filament-wound composite giving the filament-wound composite as anisotropic.

9. The apparatus of claim 1, wherein the downhole tool comprises a mandrel comprising the hollow profile, and wherein the downhole tool is a packer or a plug.

10. The apparatus of claim 1, wherein the continuous fibers impregnated with the ACT vitrimer are in the form of prepreg tapes or towpregs.

11. The apparatus of claim 1, wherein the apparatus is the hollow profile that is a pressure housing for instrumentation.

12. The apparatus of claim 1, wherein the apparatus comprises a tubular as the hollow profile, and wherein the apparatus comprises a metallic liner coupled to the tubular.

13. The apparatus of claim 1, wherein filament layers of the filament-wound composite are cross plied to increase strength of the filament-wound composite.

14. An apparatus comprising:

a first tubular for downhole in a borehole, the first tubular comprising a filament-wound composite of a first aromatic copolyester thermoset (ACT) vitrimer and continuous fibers, wherein the continuous fibers are impregnated with the first ACT vitrimer; and a second tubular coupled to the first tubular via a coating of a second ACT vitrimer on a joint tongue of the second tubular, wherein the coating provides for reversible bonding to bond and debond, wherein the first ACT vitrimer comprises a first aromatic thermosetting copolyester (ATSP) resin, and wherein the second ACT vitrimer comprises a second ATSP resin.

15. The apparatus of claim 14, wherein the second tubular is a metallic tubular, and wherein the continuous fibers are glass fibers.

* * * * *